United States Patent [19]

Tomita

[11] 4,252,620

[45] Feb. 24, 1981

[54] PROCESS FOR FORMING AN ANODIZED FILM OVER THE SURFACE OF ALUMINUM SUBSTRATES

[76] Inventor: Setsuo Tomita, No. 1-2 Fukamizo-Ohzara, Kohda-cho, Nukada-gun, Aichi-ken, Japan

[21] Appl. No.: 33,174

[22] Filed: Apr. 25, 1979

[51] Int. Cl.[3] ..... C25D 11/08; C25D 11/10; C25D 11/14

[52] U.S. Cl. ..... 204/58

[58] Field of Search ..... 204/58, 35 N

[56] References Cited

U.S. PATENT DOCUMENTS 2,963,409 12/1960 Ramirez ..... 204/58

FOREIGN PATENT DOCUMENTS 409679 4/1934 United Kingdom ..... 204/58

*Primary Examiner*—G. L. Kaplan

*Attorney, Agent, or Firm*—Birch, Stewart, Kolasch and Birch

[57] ABSTRACT

Anodized films having an aesthetic value are formed over the surface of aluminum or aluminum alloy substrates by anodizing the substrate in an electrolyte solution containing 50–60% of sulfuric acid and oxalic acid or nickel sulfate, at a bath temperature of 18° to 30° C. and a current density of 1 to 10 A/dm$^2$.

The oxide film formed by this method has a porcelain-like texture or feel or the appearance of a meshwork thereof or a grainy texture resembling wood, leather or sand, depending upon the nature of the base or substrate metal and the anodizing conditions employed.

5 Claims, No Drawings

PROCESS FOR FORMING AN ANODIZED FILM OVER THE SURFACE OF ALUMINUM SUBSTRATES

BACKGROUND OF THE INVENTION

1. Field of the Invention

The present invention generally relates to the art of surface finishing of aluminum. More particularly, it is concerned with a method of anodizing aluminum or aluminum alloys to provide the surface thereof with a porcelain-like texture, or a grainy touch having a timber, leather or sand texture of aesthetic value.

2. Description of the Prior Art

The method of finishing the surface of aluminum which involves the art of forming a protective film layer of $\gamma$-$Al_2O_3$ over a base metal by anodizing it in solutions including various electrolytes has been known in the art since the endof the 19th century.

In Japan, anodized aluminum products obtained by the use of an electrolyte of oxalic acid have been very popular since the early 1930's to the extent that the trade name "Almite" has become an accepted pronominal designation for the entire spectrum of anodized aluminum products.

Moreover, a number of papers have been published and many patents have been issued on or relating to the art of aluminum anodizing. These various references disclose the composition of the electrolyte solution, the conditions of electrolysis, the species or properties of the base metals, the pre- and post- treatment thereof for elaborately modifying the tone and color, the optical reflectance, the hardness and the flexibility of the film layer thus formed.

Among the prior art methods customarily known as "direct coloring", which are devised for depositing an appropriate metal salt in the film layer simultaneously with the formation of the layer by means of incorporating the metal salt in the electrolyte solutionused in the anodizing operation, the most famous one is the "Ematal verfahren", disclosed in the specification of German Pat. Nos. 655,100 and 672,268 issued to Schenk. According to these disclosures, the addition of salts of titanium, zirconium, thorium and the like in the conventional electrolyte solution containing oxalic acid, and the selection of direct current anodizing conditions of terminal voltage from 2–3 V to 120 V and a bath temperature ranging from 50° to 70° C., will enable the deposition of the metal salts, for instance, titanium oxide in the film layer to give the layer an opaque milky-white or porcelain-like appearance.

However, despite many efforts of the present inventor, experiments performed for confirming the stated advantages of the "Ematal verfahren" have failed to provide the preferred results of the expected oxide film having a white porcelain-like texture. In addition to the pure expense of the salts of titanium or zirconium, the "Ematal verfahren" procedure has thus been found to be unsatisfactory for commercialization or very difficult to perform as a routine operation, if not completely impossible.

As has been and is now generally accepted, white porcelains descended from the old age of China pottery patterned in the ancient traditions are highly evaluated. Among them, the tone and color of the pale-white texture of porcelains from the pottery kilns in the Southern District are regarded as being highly prized with keen envy by many enthusiasts and art collectors.

SUMMARY OF THE INVENTION

It is therefore a primary object of the present invention to provide a method of anodizing aluminum or aluminum alloys to provide a film having a porcelain-like texture thereon or a grainy touch having a timber, leather or sand texture of aesthetic value.

It is another object of the present invention to provide a method of anodizing aluminum or aluminum alloys which is capable of giving the formed film the color tone of pale grey having a bluish key tone as its background, indentifiable by the code numbers 23 A2-B2 in the "Color Atlas" (published by Kaigai Shoseki Boeki Shokai in Nov. 1962) which shows a striking similarity in color tone to the actual white porcelains.

It is still another object of the present invention to provide a method wherein the obtained oxide film is highly resistant to chemicals and mechanical abrasion.

Further objects and attendant advantages of the present invention will be apparent to those skilled in the art from the description in the following specification and the attached claims.

According to the present invention, there is provided a method of forming an anodized film over the surface of aluminum or aluminum alloys which comprises anodizing the metal in an electrolyte solution which includes 50–60% of sulfuric acid and an additive selected from oxalic acid and nickel sulfate, at a bath temperature ranging from 18° C. to 30° C. and a current density ranging from 1 to 10 A/dm$^2$.

DETAILED DESCRIPTION OF THE INVENTION

The selection of the additives and their concentration in the electrolyte solution greatly influence the property of the formed film, as discussed below. Usually, 2–10% of oxalic acid or 1–3% of nickel sulfate is incorporated in the solution.

The stated concentration range of sulfuric acid of 50–60% has been known to the art only through the scientific literature but has never been commercialized up to now. In a routine operation, a concentration under 30%, particularly one ranging from 10 to 20% is conventional. Moreover, the experience of the present inventor has demonstrated poor results in the formation of an oxide film when the concentration of sulfuric acid ranges from 30 to 50%.

Moreover, a sulfuric acid concentration exceeding 60% will lead to an unstable anodizing operation which sometimes includes surface-burning.

The incorporation of the oxalic acid additive into the electolyte solution in an amount in excess of 10% is extremely disadvantageous because the excessive oxalic acid precipitates, while an amount less than 2% will lead to an unstable operation and surface-burning. A preferred concentration of this additive ranges from 7.5 to 10%.

The concentration of nickel sulfate as another additive should not be greater than 3% in order to prevent a possibleunstable operation with a fluctuating result. When the concentration is less than 1% the expected grain of the timber texture does not appear and surface-burning may frequently occur. An appropriate concentration of this additive is suitably around 2%.

The temperature of the electrolyte solution (bath temperature) should preferably bemaintained in a range between 18° C. and 30° C. during the anodizing operation. If the temperature rises beyond the upper limit of this range, desirable results cannot be obtained because of the development of the so-called "fogging" phenomenon. When the temperature is lowered beyond the lower limit of said range, the hardness of the formed oxide film increases but its color specific to the inherent property of the base metal is deepened with the lowering of the temperature. The color is particularly darkened at a low temperature of around 5° C.

Although the initial voltage across the bath (terminal voltage) depends upon the structure and arrangement of the bath, the power supply, and the conditions employed in the anodizing operation, for instance, the temperature, the operation generally begins with a voltage around 12–13 V which rises up to 80 V duringthe progress of the film formation.

During the operation, this voltage may preferably be adjusted to maintain a constant current density ranging from about 1 to 10 A/dm$^2$ and more preferably from 3 to 5 A/dm$^2$. An increase in the current density would, of course, accelerate the rate of oxide film formation but also would simultaneously entail an increase in the heat generated in compliance with Joule's law and therefore require specifically designed cooling means for the removal of the heat.

It has been found that a system which includes a forced circulation of electrolyte solution for generating a jet stream in the bath which directly impinges the articles to be treated in order to cool them is more effective in performing the process of the present invention than any conventional aerial agitation which frequently causes local burnings or scorching.

The color and tone as well as the texture of the film which is formed by performing the method of the invention depend largely upon the species of the base metal and the conditions employed in the anodizing procedure. In order to obtain a white porcelain-like oxide film, the following requirements should be fulfilled:

(1) Base or substrate metal: Single aluminum of regular grade (99% in purity) or higher grade (99.85%)
(2) Electrolyte: Sulfuric acid - Oxalic acid
(3) Current density: 3–5 A/dm$^2$
(4) Thickness of film formed: 20–40$\mu$ In performing an anodization under typical operating conditions of 53% sulfuric acid and 10% oxalic acid at 25°±2° C. (bath temperature), it is found that a supply of current for about 30 minutes is required in order to obtain a film of about 30$\mu$ thickness at a current density of 3 A/dm$^2$. Therefore, it is apparent that the formation of the film proceeds at a rate of 1$\mu$/min. at a current density of 3 A/dm$^2$ which increases to 2$\mu$/min. at a current density of 5 A/dm$^2$.

On the other hand, the following procedure and conditions should be followed if a film having a grainy feeling of timber, leather or sand texture isdesired.

(1) Base or substrate metal:
Single aluminum of regular grade (up to 99.5% in purity, particularly, up to 99%)
Aluminum alloys for elongation; (Al-Mg-Si); 61S, 63S, and (Al-Mg); 52S, 56S
(2) Electrolyte: Sulfuric acid - Nickel sulfate
(3) Current density: 3–5 A/dm$^2$
(4) Thickness: 40$\mu$ or thicker Since the developed grains of timber, leather or sand texture are dependent upon and attributable to the fine structure of the base metals used, it is preferable to carefully select the base or substrate metal, which may be an alloy, for the expected result in strict conformity with the purpose of the anodizing. For example, the listed Al-Mg alloys develop sand-like grains in the film by raising the bath voltage up to 75 V.

Conventional pre-treatments generally applied with any method for forming oxide films are likewise important for performing the anodizing operation of the present invention in order to clean the base metal so as to obtain an electrochemically active surface. These pretreatments of the surface of the base metal include, among others, polishing, optional subduing, subsequent de-greasing with an organic solvent such as carbon tetrachloride or trichloroethylene (commercially available under the trade name "Triclane"), and removal of naturally formed oxide films by chemical treatment by (a) soaking with an aqueous solution of sodium hydroxide and (b) subsequent neutralization with nitric acid, and (c) electrolytic de-greasing followed by rinsing with running water or electrolytic polishing.

The electrolytic de-greasing referred to above as (c) is particularly suited for obtaining a beautiful film and is usually performed by electrolysis of the article to be treated as the cathode in an aqueous solution of a weak alkaline salt for about 30 seconds at a terminal voltage of 12–16 V and a current densityof 4–8 A/dm$^2$.

The anodizing operation in accordance with the present invention may be performed on aluminum articles under the stated conditions using a regular direct current power source. Use of a current of any particular pattern such as a pulsating current is not required.

The articles to be treated are desirably soaked in the electrolyte by use of racking devices made of a highly corrosion-resistant material such as titanium or titanium-clad copper or aluminum. Conventional racking devices made of aluminum are not suited because they require additional operations of stripping off the oxide film formed during the previous anodizing operation, for every subsequent operation and, if the stripping is only unsatisfactorily performed, they may become the cause of defective anodizing or flaws due to burning by sparks.

Since the formed oxide film ($\gamma$-$Al_2O_3$) is porous, it may be treated to close up the openings or holes therein by any conventional method, for instance, by treatment with hot water or steam, or treatment by soaking the articles in solutions of salts of cobalt or nickel (for example, nickel acetate). A kind of meshwork formed of innumerable mosaic cracks which run in every direction may develop over the film as a result of the rapid cooling during the rinsing step after the anodizing and give the articles a texture similar to cracked ceramics, although this phenomenon largely depends on the inherent nature of the base metal (for instance, aluminum of high purity and alloys containing magnesium).

The following Examples are given merely as being illustrative of the present invention and are not to be considered as limiting. Unless otherwise noted, the percentages therein and throughout the application are by weight.

EXAMPLES OF THE INVENTION

An anodizing procedure in accordance with the present invention is performed under the following conditions:

(1) Specimen: 1t×50 mm×100 mm.

(2) Bath: Polyvinyl chloride, 300×300×450 mm.
(3) Cathode: Graphite
(4) Power source: Silicon rectifier. 200 V, 50 A
(5) Stirring: Forced circulation by pumping througha separate heat-exchanging device.

The results as well as the attendant conditions employed in the operation are summarized in the following Table:

TABLE 1

| Specimen No. (material) | Electrolyte (Sulfuric acid, 53% in each) | Temp. (°C.) | Current Density ($A/dm^2$) | Anodizing Time (Min.) | Thickness of film ($\mu$) | Color* and Texture |
|---|---|---|---|---|---|---|
| 1. 99.5% Al | Oxalic acid, 10% | 25 ± 2 | 3 | 30 | 26 | Greenish grey (29C2) with a white porcelain-like glaze |
| 2. 99.5% Al | Oxalic acid, 10% | 25 ± 2 | 5 | 15 | 36 | Greenish grey (25C) with a white porcelain-like glaze |
| 3. 99.5% Al | Oxalic acid, 10% | 25 ± 2 | 5 | 24 | 47 | Olive color (2E2) with a greyish tone |
| 4. 99% Al | Nickel sulfate, 3% | 25 ± 2 | 5 | 30 | 63 | Greenish grey (28D2) with a sand grain texture |
| 5. 99% Al | Nickel sulfate, 3% | 20 ± 2 | 5 | 30 | 56 | Greenish grey (30D2) with a timber (elm tree) grain texture |

*Code in the Color Atlas.

As can be seen from the above description, the oxide film formed by the method of the present invention has a porcelain-like texture or feel or the appearance of a meshwork thereof, or a grainy texture resembling wood, leather or sand, depending upon the nature of the base or substrate metal and the anodizing conditions employed.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A method for forming an anodized film of aesthetic value over the surface of an aluminum or aluminum alloy substrate which comprises anodizing said aluminum or aluminum alloy substrate in an aqueouselectrolyte solution consisting essentially of 50–60% of sulfuric acid; 1–3% of nickel sulfate additive; and water, at a bath temperature of from 18° to 30° C. and a current density of from 1 to 10 $A/dm^2$.

2. A method as claimed in claim 1, wherein the anodizing is performed at a current density of from 3 to 5 $A/dm^2$.

3. A method as claimed in claim 1, wherein the anodizing is performed at a temperature of about 25° C.

4. A method as claimed in claim 1, wherein the anodizing is performed until the thickness of the film formed is in excess of 20$\mu$.

5. An aluminum or aluminum alloy substrate having an oxide film over the surface thereof prepared by the method of claim 1.

* * * * *